US008323223B1

(12) United States Patent
Woggon et al.

(10) Patent No.: US 8,323,223 B1
(45) Date of Patent: Dec. 4, 2012

(54) MECHANICAL DROP TRACTION APPARATUS

(76) Inventors: Dennis A. Woggon, Rice, MN (US); A. Joshua Woggon, Saint Cloud, MN (US); John D. Carlson, Saint Joseph, MN (US); Donald D. Winkels, Avon, MN (US)

( * ) Notice: Subject to any disclaimer, the term of this patent is extended or adjusted under 35 U.S.C. 154(b) by 338 days.

(21) Appl. No.: 12/706,685

(22) Filed: Feb. 16, 2010

Related U.S. Application Data

(60) Provisional application No. 61/152,697, filed on Feb. 14, 2009.

(51) Int. Cl.
*A61H 1/00* (2006.01)

(52) U.S. Cl. ..... 601/49

(58) Field of Classification Search ..... 601/49, 601/19, 61, 116; 606/53
See application file for complete search history.

(56) References Cited

U.S. PATENT DOCUMENTS 1,336,294 A * 4/1920 Hackman ..... 5/634
2,211,453 A * 8/1940 Buttikofer ..... 5/634
3,238,936 A 3/1966 Siedentop
3,550,587 A 12/1970 Kawada
4,586,493 A 5/1986 Goodman
4,724,828 A 2/1988 Barnes et al.
5,147,287 A * 9/1992 Jewell et al. ..... 602/32
5,320,640 A 6/1994 Riddle et al.
7,322,977 B2 * 1/2008 Pettibon ..... 606/53

* cited by examiner

*Primary Examiner* — Manuel Mendez
(74) *Attorney, Agent, or Firm* — Albert W. Watkins

(57) ABSTRACT

A wedge-shaped multiple drop traction (MDT) apparatus percussively moves at low frequencies and through displacement great enough to induce discontinuous displacement between adjacent cervical vertebrae. The MDT rests on a fixed surface beneath a patient's shoulders. A head traction applicator applies a traction force to a patient's head, and preferably a cushion is provided under the patient's head. The MDT has a motive power source mounted on a static base plate. The motive power source turns an eccentric shaft carrying bearings thereupon, and these bearings are coupled through contact pads to a vibrating plate that is pivotal with respect to the static base plate. Cushions couple the vibrating plate to the patient's back, and yet leave the spinal column unsupported and also displaced from direct contact with the vibrating plate. Additional synergy is obtained with smaller amplitude vibration therapy applied simultaneously to the cervical vertebrae region.

18 Claims, 4 Drawing Sheets

MECHANICAL DROP TRACTION APPARATUS

CROSS REFERENCE TO RELATED APPLICATIONS

This application claims priority to U.S. provisional patent application Ser. No. 61/152,697 filed Feb. 14, 2009 of the same title and inventorship, the contents which are incorporated herein by reference in entirety.

BACKGROUND OF THE INVENTION

1. Field of the Invention

This invention pertains generally to surgery, and more particularly to kinesitherapy apparatus and methods. Various manifestations more particularly pertain to apparatus and methods used to treat spinal disorders in the cervical and thoracic regions.

2. Description of the Related Art

A number of disorders are known which afflict the neuromusculoskeletal systems of vertebrates, the most notorious and of greatest interest both herein and in the prior art generally being those which more specifically afflict man and closely related mammals. Many of these disorders have been uniquely established through extensive research and field observation. The characteristics and symptoms of a myriad of such disorders permit them to be accurately diagnosed. However, once diagnosed, there is a serious need for the most rapid and effective treatments in order to alleviate, or where possible, cure the patient of the symptoms associated with the disorder. Unfortunately, many of these disorders arise through complex mechanisms which are not fully understood, and for which adequate treatments have not been arrived at. Furthermore, many of these disorders afflict both soft and hard tissues, which makes effective treatment all the more difficult.

One area of research in the treatment of humans involves the use of vibration, typically in concert with gravitational forces. Movements, such as various exercises, are known to be combined separately or in association with the vibration therapy, and are reported to be enhanced by the vibration. While much has been reported with regard to the general application of such therapies, little has been provided heretofore to enable a medical practitioner to specifically, efficiently and effectively target a vibratory treatment to produce neuromusculoskeletal proprioceptive re-education within the cervical vertebrae of a human being.

Exemplary prior art methods and apparatus which attempt treatment of the cervical vertebrae are illustrated in U.S. Pat. Nos. 4,724,828 by Barnes et al, entitled "Cervically adjustable chiropractic treatment table"; and 7,322,977 by Pettibon, entitled "Spinal adjusting device and method", the contents of each which are incorporated herein by reference. Each of these patents disclose apparatus designed to suddenly drop through a significant and consequential distance, thereby facilitating adjustment of the cervical vertebrae. For some injuries or imbalances, a single drop or a few temporally displaced drops are adequate and provide the needed restoration of health and well being. However, the single drop can be traumatic, and may still require significant additional manual work on the spinal column to achieve the desired state of health.

In contrast to the Barnes et al and Pettibon patents, other artisans have instead relied upon far gentler methods of massage and vibration. Exemplary of these are U.S. Pat. Nos. 3,238,936 by Siedentop, entitled "Apparatus for mechanical corrective therapy"; 3,550,587 by Kawada, entitled "Spine corrector combined with automatic therapeutic device for digital pressing therapy"; 4,586,493 by Goodman, entitled "Therapy table"; and 5,320,640 by Riddle et al, entitled "Continuous passive motion cervical spine therapy device", the contents of each which are incorporated by reference for their teachings of vibratory treatment and the myriad of disorders to which such treatments have been applied. These patents teach methods of performing therapies through repetitive flexion and extension, generally at very low frequencies to attempt to induce desirable circulation and growth or repair within connective tissues within the human body. However, a number of injuries, particularly to the neck or cervical vertebrae, result in a displacement which is not easily corrected by these relatively gentle techniques.

In addition to the foregoing patents, Webster's New Universal Unabridged Dictionary, Second Edition copyright 1983, is incorporated herein by reference in entirety for the definitions of words and terms used herein.

SUMMARY OF THE INVENTION

In a first manifestation, the invention is a percussive and vibratory treatment apparatus, comprising in combination a treatment surface; a head traction applicator; a percussive and repetitive thoracic mechanical drop traction apparatus supported upon the treatment surface; and a cervical vertebrae vibrating traction device located between the head traction applicator and percussive and repetitive thoracic mechanical drop traction apparatus. The head traction applicator is operatively coupled to a patient's head and applies a traction force thereto. The percussive and repetitive thoracic mechanical drop traction apparatus is operative between the treatment surface and a patient's thorax. The cervical vertebrae vibrating traction device is operative between the treatment surface and a patient's cervical vertebrae.

In a second manifestation, the invention is a mechanical drop traction apparatus, comprising a static plate; a motive power source coupled to the static plate; and a vibrating plate moved by the motive power source with respect to the static plate.

In a third manifestation, the invention is a method of neuromusculoskeletal proprioceptive re-education of a patient having a thorax, a skull, and cervical vertebrae coupling said thorax to said skull. In accord with the method, the skull has a traction force applied thereto. Next, the thoracic vertebrae is repetitively percussed while simultaneously vibrating cervical vertebrae.

OBJECTS OF THE INVENTION

Exemplary embodiments of the present invention solve inadequacies of the prior art by providing a generally wedge-shaped multiple drop traction apparatus that percussively moves at frequencies low enough and through displacement distances great enough to induce discontinuous and sudden displacement between adjacent vertebrae, commonly referred to as "snapping" the vertebrae into alignment. The MDT is placed onto a fixed surface such as a treatment table or the like, beneath a patient's shoulders with the spinal column extending unsupported between two cushions. A head traction applicator applies a traction force to a patient's head, and preferably a cushion is provided under the patient's head. While in some instances motion of the MDT is sufficient to achieve corrective therapy and patient health, additional synergy may be obtained with smaller amplitude vibration therapy applied simultaneously to the cervical vertebrae region, in the preferred embodiment using a vibration therapy device placed under the patient's neck. The MDT preferably incorporates a motive power source such as an electric motor onto a static base plate. The motive power source turns an eccentric shaft carrying bearings thereupon, and these bearings are coupled preferably through somewhat elastomeric contact pads to a vibrating plate that is pivotal with respect to the static base plate. Cushions couple the vibrating plate to the patient, for exemplary purposes to the thoracic region and adjacent to the cervical region, and yet leave the spinal column unsupported and also displaced from direct contact with the vibrating plate.

A first object of the invention is to provide postural improvements and rehabilitation in the musculo-skeletal system. A second object of the invention is to enable efficient, effective, safe and reliable adjustment and treatment of cervical vertebrae. Another object of the present invention is to induce a plurality of temporally displaced drops that are adequate to provide restoration of health and well being, while reducing trauma and manual work on the spinal column to achieve a desired state of health. A further object of the invention is to provide an apparatus which may be used in meeting the foregoing objectives which provides safe and reliable operation, and which provides desired percussive treatment. Yet another object of the present invention is to provide such apparatus in a small and portable package that may be used with existing tables or work surfaces.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Manifested in the preferred embodiment, the present invention provides both apparatus and methods for efficiently and effectively treating disorders of the cervical region of the spinal column. In a most preferred embodiment of the invention illustrated in FIG. 1, a preferred embodiment Mechanical Drop Traction (MDT) apparatus 100 designed in accord with the teachings of the invention is illustrated in use in accord with a preferred method of the invention in combination with a patient 10 whose head is resting upon a cushion 20 and whose cervical spinal region is resting upon a Vibrating Traction (VT) apparatus 40. VT apparatus 40 is illustrated and described more thoroughly in the present applicants' granted U.S. Pat. No. 7,402,145 and co-pending patent application Ser. Nos. 12/143,507 and 12/143,508, the contents of each which are incorporated herein by reference.

Figure 1:
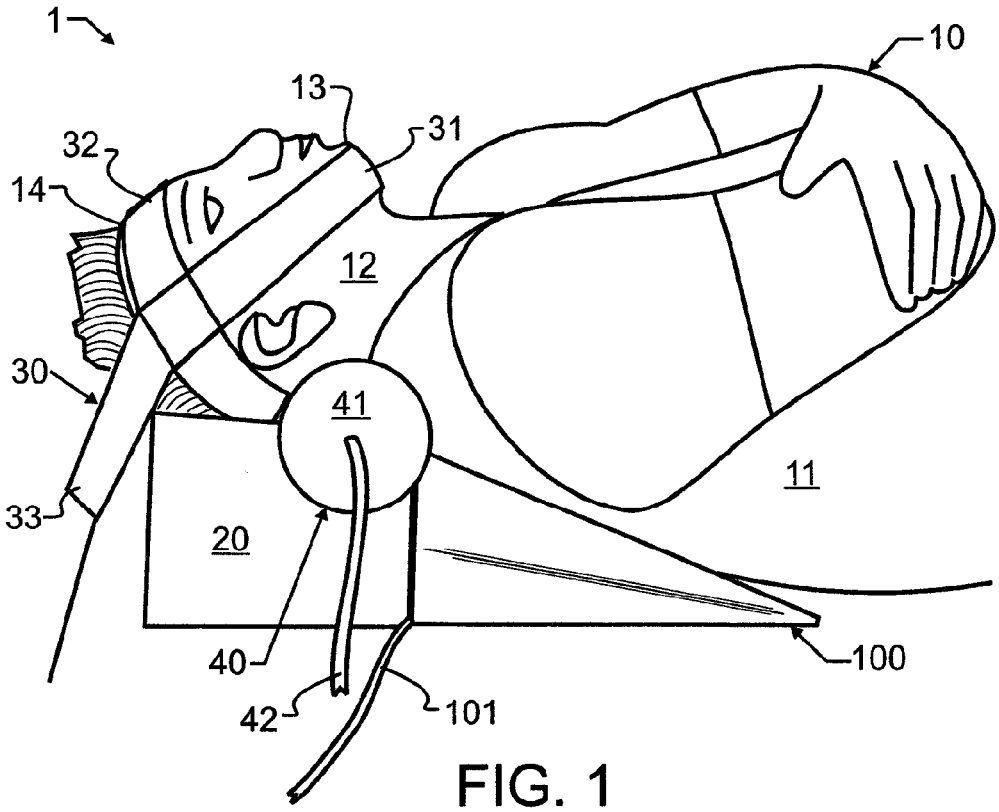
FIG. 1 illustrates a preferred embodiment mechanical drop traction apparatus designed in accord with the teachings of the invention from side plan view in further combination with a VT and practicing a preferred method of the invention.
Figure 2:
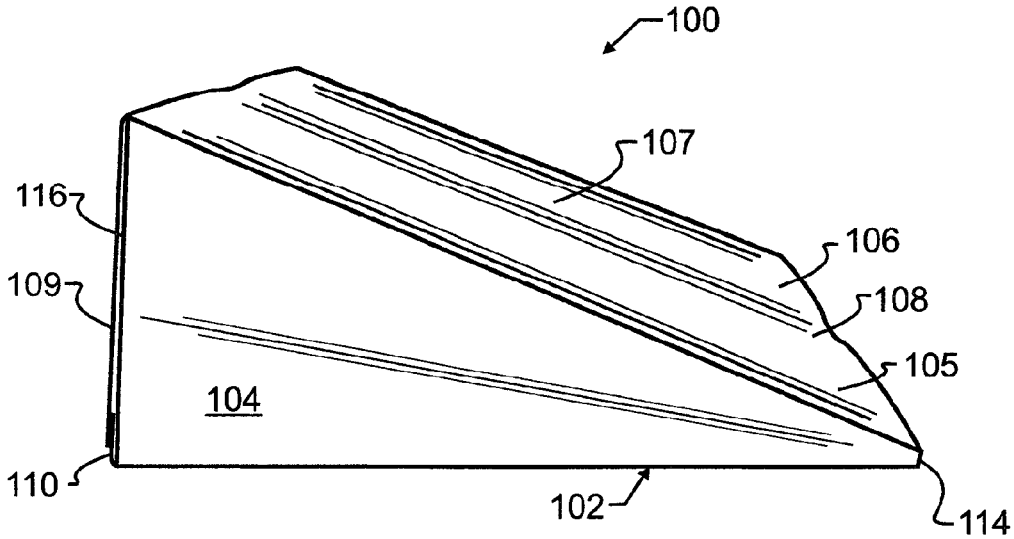
FIG. 2 illustrates the preferred embodiment mechanical drop traction apparatus of FIG. 1 from a slightly projected side view, with a cover and cushions in place.
Figure 3:
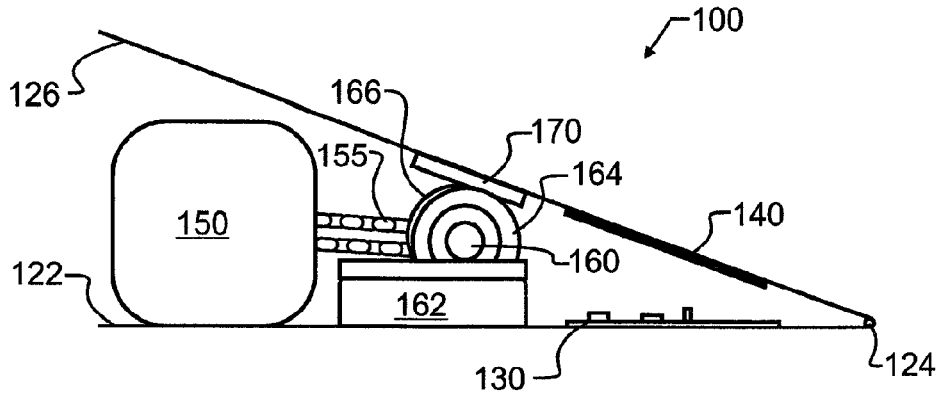
FIG. 3 illustrates the preferred embodiment mechanical drop traction apparatus of FIG. 1 from a side plan view, in an operative position with cover and cushions removed.

As illustrated in FIG. 1, a patient 10 will preferably be positioned with the thoracic region 11 vertebrae centered upon the longitudinal center 108 of MDT 100. MDT 100 from side 104 as illustrated in FIGS. 1 and 2 takes a general wedge geometry, meaning that MDT 100 is taller along vertical side 116 adjacent the patient 10 cervical region 12 vertebrae than at hinge 114 adjacent the lumbar vertebrae.

In operation, and as will be better understood from the additional descriptions herein below, MDT 100, which may for exemplary purposes be powered through electrical cord 101, changes in elevation by pivoting about hinge 114 adjacent the shorter edge, also adjacent the lumbar vertebrae. This means that thoracic region 11 vertebrae most nearly adjacent to the cervical region 12 vertebrae will be percussed up and down during operation. The amount of travel and frequency of vibration will be varied through design and adjustment by those skilled in the art to meet the needs of a patient 10 or application. In the preferred embodiment, the amount of travel of vibrating plate 126 distal to hinge 114 and adjacent vertical side 116 is approximately ⅜", at a frequency of approximately 20 Hertz, though both travel and frequency may be varied widely therefrom if so desired.

Traction is achieved in the preferred embodiment by anchoring the head of patient 10 using an anchor strap 30. Anchor strap 30 has a head strap 32 and chin strap 31, or other suitable apparatus for securing the patient's head, coupled to a fixed anchor 33 that may be static with respect to the building or furniture, such as a floor or table, or which may be a suspended mass. A cushion 20 is provided which is preferably firm but comfortable. Cushion 20 may preferably dampen any vibration to avoid coupling movement of MDT 100 into the patient's head.

In accord with the preferred method, repetitive drops afforded by MDT 100 combined with traction through anchor strap 30 provides advanced neuromusculoskeletal proprioceptive re-education, and may therefore be used therapeutically to the benefit of patients. Where desired, the preferred MDT apparatus 100 may be used in further combination with a VT 40 such as illustrated in U.S. Pat. No. 7,402,145 naming the present applicants as inventors. VT 40 comprises an eccentric body 41 which transmits vibration into cervical region 41, and is powered, for exemplary purposes, through a rotating power shaft 42. This combination of VT 40 and MDT 100 enables both thoracic and cervical vertebrae to be simultaneously moved, with special synergy within the cervical vertebrae resulting therefrom.

Figure 5:
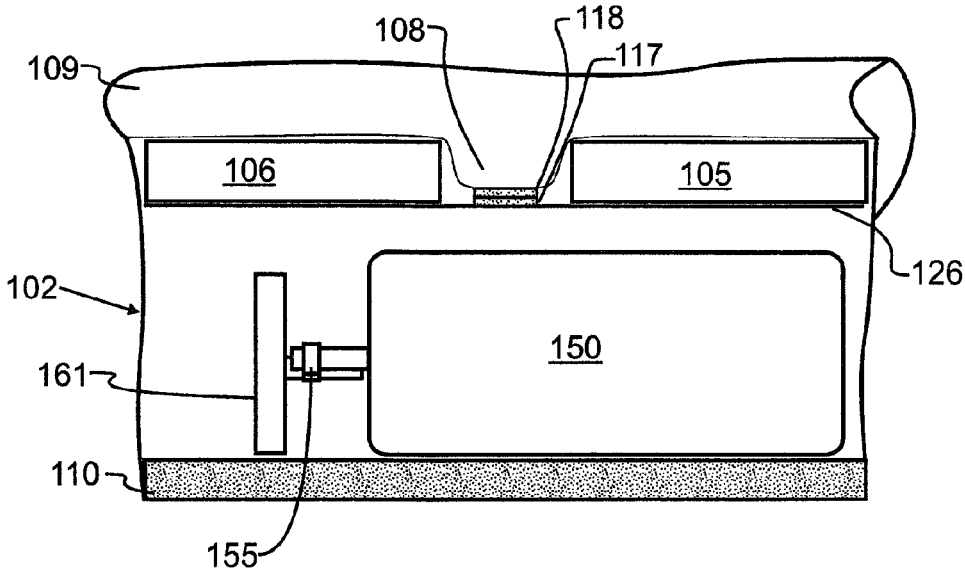
FIG. 5 illustrates the preferred embodiment mechanical drop traction apparatus of FIG. 2 from an end view with the cover opened to reveal internal components.

FIGS. 1-3 and 5 illustrate the preferred embodiment mechanical drop traction apparatus MDT 100 in a ready-to-use position. As discussed herein above, a regular power cord 101 may provide electrical energy to the apparatus, and a timer or other suitable switch, not illustrated, may be provided to control the duration of treatment. A protective cover 102 visible in FIGS. 2 and 5 is provided over the mechanical components of MDT 100, and thereby facilitates cleaning between uses and ensures that clothing, hair, jewelry and other objects do not become inadvertently caught within the internal mechanical components of MDT 100. In the preferred embodiment, cover 102 is a soft yet durable vinyl such as upholstery vinyl or other suitable material.

FIG. 5 illustrates cover 102 opened, to reveal internal mechanical components. Cover 102 is secured in a closed position using hook and loop fasteners 110, 112 such as are sold under the Velcro trademark, or any other suitable fastener. Where appropriate, additional or different fasteners or securing apparatus may be provided to prevent access by those not skilled or qualified with working with the electrical and electronic apparatus. Static plate 122 and motor 150 mounted thereon are visible, as is vibrating plate 126. During operation, static plate 122 will normally remain static relative to an underlying support such as a patient table or floor, while vibrating plate 126 will rotate, resulting in a small up and down motion of the end of the vibrating plate visible in FIG. 5. A pair of cushions 105, 106 are provided on top 107 of vibrating plate 126, and a gap 108 remains therebetween. Cushions 105, 106 may be fabricated from a variety of suitable materials, but in the preferred embodiment they are fabricated from a relatively thick felt, which transmits the force without discomfort or injury to a patient undergoing treatment. The gap 108 between cushions 105, 106 will most preferably be sufficiently wide to avoid any mechanical contact with the vertebral or spinal region of a person's back, and will instead couple movement through the scapula, rib cage, and surrounding muscle, skin and other tissue. This gap 108 and the provision of suitable cushions 105, 106 ensures that the patient is not bruised or otherwise harmed by the rapid movements, while also ensuring free movement and repositioning of the vertebrae.

Optionally, but preferably, within the spinal gap 108 between cushions 105, 106, a hook and loop fastener 117, 118 is provided which positively anchors cover 102 to vibrating plate 126. This fastener pair 117, 118 ensures that there is no flapping of cover 102, nor any undesirable wear or friction between either cover 102 and vibrating plate 126 or between cover 102 and the patient's back or spinal column.

Figure 4:
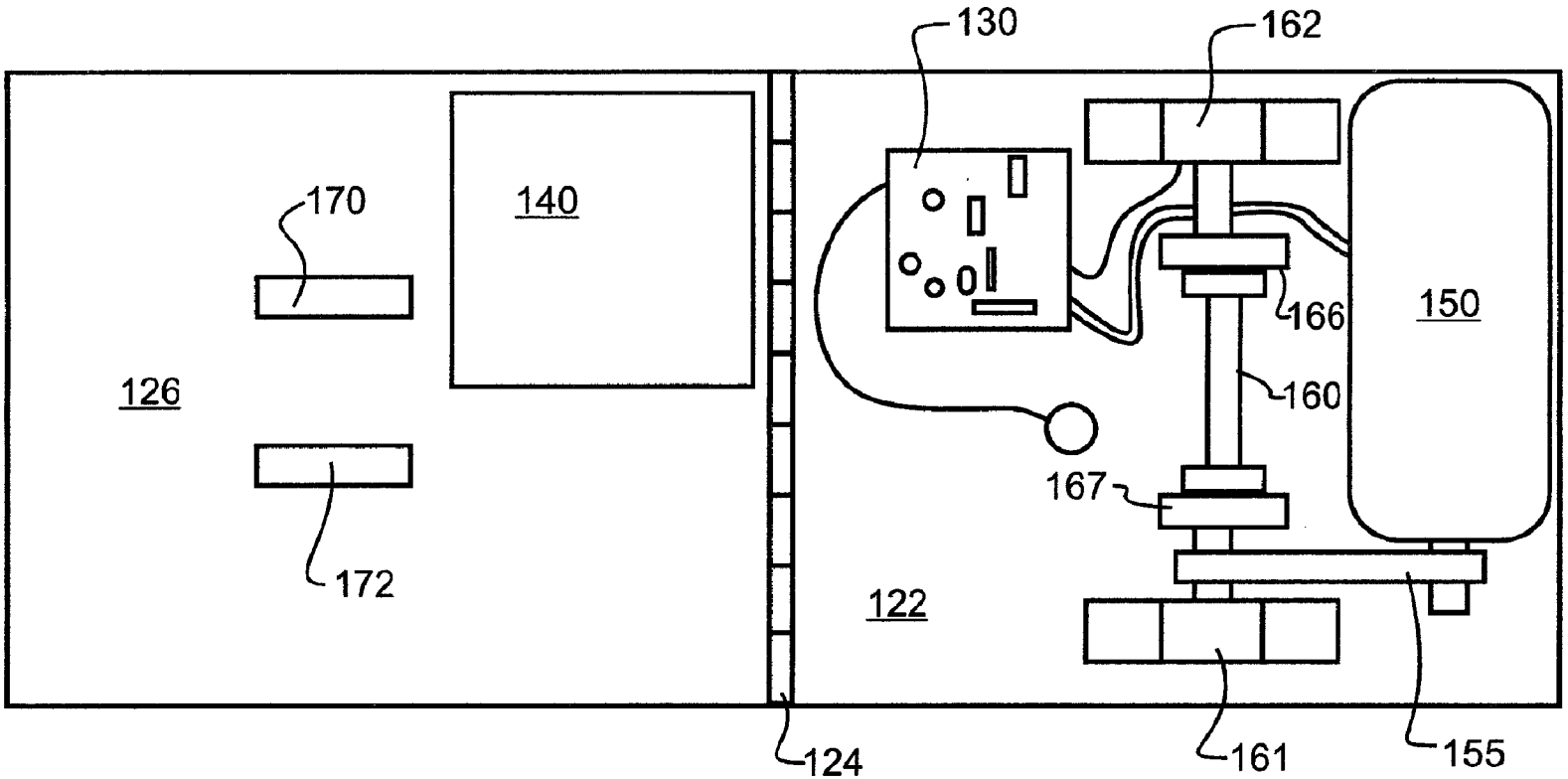
FIG. 4 illustrates the preferred embodiment mechanical drop traction apparatus of FIG. 3 from a top view with the vibrating plate pivoted to an inoperative open position.

FIG. 4 illustrates one preferred arrangement of static plate 122 and vibrating plate 126, and all components supported thereon. Included on static plate 122 are electric motor 150, drive chain 155 which may be a chain, belt or other suitable means of power transmission, bearing blocks 161, 162 supporting eccentric shaft 160 and eccentrically carried bearings 166, 167, and electric motor control circuitry 130. Electric motor control circuitry 130 may be designed to perform many functions, or may alternatively be very limited in capability. More particularly, electric motor control circuitry 130 might for exemplary purposes include circuitry to vary the voltage, frequency, speed and/or torque of motor 150, to sense dangerous conditions such as motor overload, unsafe opening or travel of vibrating plate 126, vibration and/or rpm of eccentric shaft 160, and any other capabilities that may be known in the field of electric motors. In contrast, electric motor control circuitry 130 may simply comprise an on-off switch. Included on vibrating plate 126 are non-conductive or high resistivity electrical shield 140, and a pair of contact pads 170, 172.

In operation, eccentric shaft 160 is supported for rotation by the two spaced bearing blocks 161, 162 that support bearings such as bearing 164 visible in FIG. 2. Eccentric shaft 160 may be machined or otherwise fabricated to be offset similar to a crankshaft, such that during rotation the centers of the two vibration induction bearings 166, 167 actually travel about a circle. In other words, vibration induction bearings 166, 167 are not co-axial with the bearings 164 in bearing blocks 161, 162. In operation, vibration induction bearings 166, 167 are in contact with contact pads 170, 172 mounted on vibrating plate 126, and as eccentric shaft 160 turns, vibration induction bearings 166, 167 will travel up and down and also back and forth. Up and down motion is transferred through contact pads 170, 172 to generate desired vertical travel. As vibration induction bearings 166, 167 travel, they are free to roll in surface contact with contact pads 170, 172, so the back and forth motion produces minimal or no relative wear.

Preferred contact pads 170, 172 are mounted on vibrating plate 126, and may be permanently attached or more preferably removably attached to be replaced over time as a wear part. These contact pads are preferably relatively abrasion resistant and at least slightly elastomeric, so that smaller high frequency vibrations are not coupled through the contact pads, nor is there any undesirable sound generated by the induced vibrations. Furthermore, slight elasticity also ensures that there is no denting or damage of either the vibrating plate or the vibration induction bearings during shipping, handling and use. Depending upon the weight of the person being treated, there may be relatively large forces applied between the contact pads and the vibration induction bearings. While there are a variety of suitable materials, in the preferred embodiment the contact pads are fabricated from reinforced rubber, similar to automobile tire rubber or the like.

From these figures and foregoing descriptions, it will be understood that MDT 100 may be manufactured from a variety of materials, including metals, resins and plastics, ceramics or cementitious materials, composites, laminates or combinations of the above. Furthermore, the uses and applications for MDT 100 will extend beyond the preferred embodiment cervical vertebrae treatment methods disclosed herein, and such further application to other kinesitherapy is contemplated herein.

Figure 6:
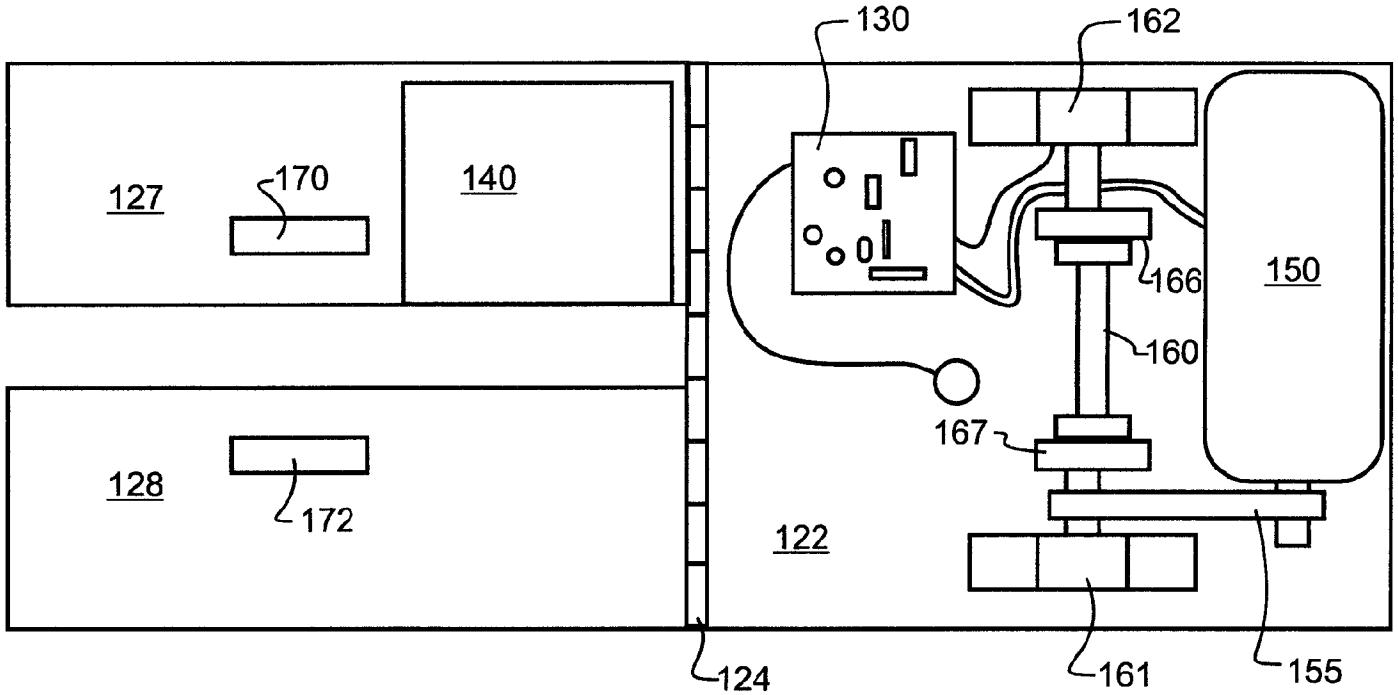
FIG. 6 illustrates a first alternative embodiment mechanical drop traction apparatus from a top view with the vibrating plate pivoted to an inoperative open position, similar to the preferred embodiment view of FIG. 4.

In one alternative embodiment contemplated herein and illustrating in FIG. 6, vibrating plate 126 may be divided into two smaller and separately pivotal plates 127, 128. Rather than vibrating plate 126 extending under cushions 105, 106 and gap 108, these two separately pivotal plates 127, 128 may be provided, each extending only under an associated cushion. In this embodiment then, there is a vibrating plate 127 under cushion 105, and a second vibrating plate 128 under cushion 106, with a small gap corresponding to gap 108 between each of the two vibrating plates. In this alternative embodiment, eccentrically carried bearings 166, 167 do not have to rise and fall in unison, and may alternatively be designed to rise and fall in any relationship to each other. In other words, in a most extreme arrangement, bearing 166 might be set to rise while bearing 167 falls. This will cause not only a percussive force to be applied to the patient, but will also induce a rolling motion. This may be applied not only to the thoracic region, but may be useful in other treatments as well, as will be apparent to those reasonably skilled in kinesitherapy and the art of chiropractic treatments.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

We claim:

1. A percussive and vibratory treatment apparatus, comprising in combination:

a treatment surface;

a head traction applicator;

a percussive and repetitive thoracic mechanical drop traction apparatus supported upon said treatment surface; and a cervical vertebrae vibrating traction device located between said head traction applicator and said percussive and repetitive thoracic mechanical drop traction apparatus;

said head traction applicator operatively coupled to a patient's head and applying a traction force thereto;

said percussive and repetitive thoracic mechanical drop traction apparatus operative between said treatment surface and a patient's thorax; and said cervical vertebrae vibrating traction device operative between said treatment surface and a patient's cervical vertebrae.

2. The percussive and vibratory treatment apparatus of claim 1, wherein said percussive and repetitive thoracic mechanical drop traction apparatus comprises:

a static plate;

a motive power source coupled to said static plate; and a vibrating plate moved by said motive power source with respect to said static plate.

3. The percussive and vibratory treatment apparatus of claim 2, wherein said percussive and repetitive thoracic mechanical drop traction apparatus further comprises:

first and second thoracic contact regions with a patient defining a patient contact surface of said vibrating plate; and a gap between said first and second thoracic contact regions and adjacent to a patient's spinal column to provide a void into which said patient's spinal column may pass.

4. The percussive and vibratory treatment apparatus of claim 3, wherein said vibrating plate further comprises two separate vibrating plates that are each independently pivotal from the other with respect to said static plate.

5. The percussive and vibratory treatment apparatus of claim 2, wherein said vibrating plate is pivotal with respect to said static plate.

6. The percussive and vibratory treatment apparatus of claim 5, further comprising:

an eccentric shaft driven by said motive power source; and bearings supported on said eccentric shaft and traveling in an eccentric orbit when said eccentric shaft rotates, said bearings driving said vibrating plate to pivot about said static plate.

7. The percussive and vibratory treatment apparatus of claim 6, further comprising elastomeric contact pads coupled with said vibrating plate and operatively engaging with said eccentrically orbiting bearings.

8. A percussive and repetitive mechanical drop traction apparatus, comprising:

a static plate;

a motive power source coupled to said static plate;

a percussive plate repetitively moved by said motive power source with respect to said static plate;

first and second thoracic contact regions with a patient defining a patient contact surface of said percussive plate; and a gap between said first and second thoracic contact regions and adjacent to a patient's spinal column to provide a void into which said patient's spinal column may pass.

9. The mechanical drop traction apparatus of claim 8, wherein said vibrating plate further comprises first and second separate vibrating plates that are each independently pivotal from the other with respect to said static plate.

10. A percussive and repetitive mechanical drop traction apparatus, comprising:

a static plate;

a motive power source coupled to said static plate; and a percussive plate pivotal with respect to said static plate and repetitively moved by said motive power source with respect to said static plate;

an eccentric shaft driven by said motive power source; and bearings supported on said eccentric shaft and traveling in an eccentric orbit when said eccentric shaft rotates, said bearings driving said percussive plate to pivot about said static plate.

11. The mechanical drop traction apparatus of claim 10, further comprising elastomeric contact pads coupled with said percussive plate and operatively engaging with said eccentrically orbiting bearings.

12. The mechanical drop traction apparatus of claim 11, wherein said elastomeric contact pads are removably coupled with said percussive plate.

13. A method of neuromusculoskeletal proprioceptive re-education of a patient having a thorax, a skull, and cervical vertebrae coupling said thorax to said skull, comprising the steps of:

applying a traction force to said skull;

repetitively percussing said thoracic vertebrae while said skull remains in traction; and vibrating said cervical vertebrae during said repetitive percussing step.

14. The method of neuromusculoskeletal proprioceptive re-education of a patient of claim 13, wherein said step of repetitively percussing said thoracic vertebrae comprises alternately percussing each side of said thorax adjacent to said thoracic vertebrae.

15. The method of neuromusculoskeletal proprioceptive re-education of a patient of claim 13, wherein said step of applying a traction force to said skull further comprises the steps of:

laying said patient in a supine position upon a treatment surface; and engaging a patient's head with a tension force.

16. The method of neuromusculoskeletal proprioceptive re-education of a patient of claim 15, wherein said tension force further comprises a weight suspended from said patient's head.

17. The method of neuromusculoskeletal proprioceptive re-education of a patient of claim 15, wherein said step of repetitively percus sing said thoracic vertebrae while said skull remains in traction further comprises the step of moving thoracic vertebrae most adjacent to cervical vertebrae more than thoracic vertebrae distal to cervical vertebrae.

18. The method of neuromusculoskeletal proprioceptive re-education of a patient of claim 15, wherein said step of repetitively percussing said thoracic vertebrae comprises repetitively percussing said thorax adjacent to said thoracic vertebrae.

* * * * *